US008291611B2

(12) United States Patent
Eriksen

(10) Patent No.: US 8,291,611 B2
(45) Date of Patent: Oct. 23, 2012

(54) MULTIPLE STAGE EVEN-DRYING WOOD KILN SYSTEM AND METHOD

(76) Inventor: Timothy L. Eriksen, Gold Bar, WA (US)

( * ) Notice: Subject to any disclaimer, the term of this patent is extended or adjusted under 35 U.S.C. 154(b) by 0 days.

(21) Appl. No.: 13/106,152

(22) Filed: May 12, 2011

(65) Prior Publication Data

US 2011/0271546 A1 Nov. 10, 2011

Related U.S. Application Data

(60) Provisional application No. 61/360,172, filed on Jun. 30, 2010.

(51) Int. Cl.
*F26B 5/04* (2006.01)
*F26B 13/30* (2006.01)

(52) U.S. Cl. ..... 34/381; 34/403; 34/407; 34/408; 34/412; 34/73; 34/92

(58) Field of Classification Search ..... 34/60, 61, 34/72, 73, 76, 90, 92, 380, 381, 402, 403, 34/406, 407, 408, 412, 427
See application file for complete search history.

(56) References Cited

U.S. PATENT DOCUMENTS 1,050,151 A 1/1913 Loomis
1,197,097 A 9/1916 Banks
1,333,848 A 3/1920 Jones
1,672,325 A 6/1928 Kintz
1,763,070 A 6/1930 Shinn
1,778,079 A 10/1930 Kristensson
2,296,546 A 9/1942 Toney
2,621,492 A 12/1952 Beardsley et al.
3,135,589 A 6/1964 Stokes
3,521,373 A 7/1970 Pagnozzi
3,921,309 A 11/1975 Nakayashiki
4,194,296 A 3/1980 Pagnozzi et al.
4,467,532 A 8/1984 Drake
4,620,373 A 11/1986 Laskowski et al.
5,392,530 A 2/1995 Izumi
5,819,436 A 10/1998 Helevirta
6,865,821 B2 3/2005 Merschat

*Primary Examiner* — Jiping Lu
(74) *Attorney, Agent, or Firm* — Dean A. Craine

(57) ABSTRACT

A wood kiln system and method that sequentially cures and dries layers of stacked wood during which each layer of wood is heated to 125 to 170 deg. F. as the kiln container is evacuated to approximately 13 inches of Hg for 8 to 12 hrs. After the wood has been cured, drying stage is commenced as the wood is continuously heated by evacuating the kiln container to 0.35 to 3 inches of Hg for 6 to 12 hrs. During the drying stage, a cold water bath is formed in the bottom of the kiln container. A condensation tank located between the vacuum pump and the kiln is used to continuously remove the water and water vapor from the kiln container. In one embodiment, the vacuum pump includes a primary vacuum pump serially connected to an auxiliary vacuum pump that allows the air to be continuously and gradually reduced in the kiln container.

17 Claims, 10 Drawing Sheets

MULTIPLE STAGE EVEN-DRYING WOOD KILN SYSTEM AND METHOD

This is a utility patent application which claims benefit of U.S. Provisional Application No. 61/360,172, filed on Jun. 30, 2010.

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

This invention pertains to kilns used to dry wood, and more particularly kilns that used heat and a vacuum to dry wood.

2. Description of the Related Art

After the wood has kiln dried, the wood is lighter, easier to transport, stronger, contains fewer infestations, less susceptible to shrinkage, and easier to cut and stain.

Today, recently cut wood is pre-dried by being stacked in piles and 'air dried'. During this stage, air that flows over the wood exposed surfaces and any free water located on the exposed surface and in the cells located adjacent to the surfaces to slow evaporated. Unfortunately, the pre-drying stage can be 1.5 to 5 months depended on the temperature and humidity. After the pre-drying stage have been completed, the moisture content of the wood is still relatively high, 25 to 33% (by weight).

To remove more water from the wood, the wood is placed in a kiln wherein hot air is circulated around the surfaces of the wood to evaporate more water. While the temperature of the wood may be increased a small amount which causes more evaporation, the moisture content of the wood is still between 6-19% (by weight).

Unfortunately, the kiln drying process that relies on hot air circulated over the exposed surface of wood is energy inefficient and causes substantial damage to the wood itself. Also, the rates of evaporation can vary that can cause uneven drying that leads to case hardening, cracking and cellular collapse.

SUMMARY OF THE INVENTION

It is an object of the present invention to provide a drying kiln system for wet or pre-dried wood that efficiently dries the wood quickly and with minimal damage to the wood.

It is an object of the present invention to provide such a method for drying wood that uses less energy.

A key aspect of this invention is the discovery is that a major source of damage or discoloration of wood is caused by uneven removable of water from wood during the kiln drying process.

Another keys aspect of the invention is that the kiln drying process can be divided down into a 'cooking stage' during which the wood is heated under mild vacuum conditions so that any insects, molds and bacteria are eradicated, and into a 'drying stage' that uses heat and greater vacuum condition that causes trapped or closed water located deep inside the wood is evenly removed. By sequentially executing the two stages in the same kiln container the energy efficiency of the kiln system is enhanced.

The kiln system disclosed herein uses a sealable kiln container in which stack layers of wood is placed. The stack layers of wood is loaded onto a removable support platform that slides longitudinally back and forth in the kiln container. Assembled on the support platform is a platen assembly that includes a plurality of platens which are horizontally stacked in between layers of stacked wet wood. The individual layers of wet wood are longitudinally aligned in between the platens with their front and back ends and sides are exposed.

Each platen includes a plurality of horizontal, hollow tubes that connected to a vertically aligned inlet manifold. The inlet manifold connects to an input hot water port located on one side of the kiln container. Each platen is also connected to a vertically aligned output manifold that connects to an output hot water port located on the opposite side of the kiln container. During operation of the two stages, hot water flows continuous through each platen and directly heats the adjacent wood layers.

Located at an elevated location on the kiln container is a vacuum port. Connected to the vacuum port is a main vacuum conduit that connects to a primary vacuum system that partially evacuates the air inside the kiln container during the 'cooking stage'. In one embodiment of the invention, the primary vacuum system is used with an auxiliary vacuum system and an optional vacuum storage system that creates greater vacuum pressure and may be used to quickly lower the air pressure inside the kiln container.

During operation, each layer of wood in the stack is heated evenly under different vacuum conditions. During the 'cooking stage', very little evaporation occurs. During the 'drying stage' however, large amounts of evaporation occur and the condensed water must be removed from the kiln container.

In order to remove condensation from the kiln container, a water vapor removal sub-system is used. More specifically, the water vapor removal sub-system includes two downward air ducts located adjacent to the opposite sides of the platen assembly and along the inside surfaces of the opposite side walls. The water vapor removal sub-system also includes fans mounted along the ceiling of the kiln container and above the air ducts that force the hot, moist air downward along the sides and ends of the stacked layers of wood. The support platform is located along the bottom of the kiln container and during operation, sits over a cold water bath. When hot, moist air is forced downward in the air ducts, it is then evenly distributed through baffles formed on the support platform and over the top surface of the cold water bath where it is cooled and condenses. The support platform then redirects the cooled, less moist air upward and over the ends of the exposed surfaces of the wood layers where it is warmed and picks up moisture from the wood. The circulation of the hot moist air is carried out continuously or intermittently inside the kiln container during the 'drying stage'

The water vapor removed sub-system also includes a cold bath formed in the kiln container and under the support platform. Submerged in the cold water bath is a cold water conduit system designed to continuously deliver cold water to the cold water bath.

The water vapor removal sub-system also includes a primary condensation tank connected to the kiln container and covered to the primary and auxiliary vacuum systems.

When wood is placed onto the support platform and the platens, the 'cooking stage' is first initiated. The kiln container is closed and the platens are filled with hot water from the hot water source. The primary vacuum system is activated which gradually lowers the air pressure inside the kiln container to approximately 13 inches of Hg pressure. The hot water in the platens gradually heats the stacked in layers of wood until each layer of wood is heated to approximately 165 degrees F. Because heat is directly applied to the individual layers of wood and not to the surrounding air, heating is faster and the entire layer is heated to the same temperature which reduces case hardening. Once the wood reaches 165 degrees F. under moderate vacuum, the primary vacuum system is then turned off and the wood layers are allowed to slowly cook at 165 degrees F. continuously for 8 to 12 hours depending on the amount of wood, the type of wood, and the wood's initial moisture content.

After the 'cooking stage' has been completed, the kiln container remains closed and the 'drying stage' is then immediately initiated. During the 'drying stage', hot water is still continuously supplied to the platens but the air pressure inside the kiln container is gradually lowered by the primary pump system. During the 'drying stage', the air pressure is lowered to 0.35 to 1 inch of Hg pressure. In one embodiment, the primary pump system is connected to the auxiliary pump system to quickly evacuate the kiln container. When a primary pump system and the auxiliary pump system are used, the primary pump system is a positive displacement pump and the auxiliary vacuum system includes at least one axial flow vacuum pump. The axial flow pump is aligned with the positive displacement pump so that the axial flow pumps' output or exhaust ports is connected to the air input port on the positive displacement pump thereby enabling lower pressures to be created inside the kiln container than if the positive displacement pump were used alone.

In addition to using the primary and auxiliary pump systems, the system may also use a vacuum storage system that when opened, quickly lowers and equalize the air pressures between the connecting conduits and the two vacuum pump systems.

Because the amount of moisture in the wood can vary, the operator should monitor the amount of water being removed during each stage. During the 'cooking stage', a relatively small amount of water (less than 1%) is normally collected in the bottom of the kiln container after 12 hours. During the 'drying stage', however, a larger amount of water (approximately 90%) is removed from the wood because the air pressure inside the kiln container is lowered. In the embodiment disclosed herein, mounted on the door of the kiln container is an optional viewing window and disposed between the kiln container and the primary condensation tank is a collection tube. During operation, the operator may visually monitor the activity inside the kiln container via the viewing window and watch the flow of water through the collection tube.

In the event the 'drying stage' stalls so that no water is being deposited into the primary condensation tank, an optional electron wood charging unit may be used to provide an electric current to the layers of wood. The electron wood charging unit includes a plurality of wires that extended longitudinally over or between the individual layers of wood which is selectively energized by the operator.

It should be understood that the kiln system is a closed system and that releases no or very little pollutants into the environment. The system may be manually operated by one or more operators or computer-aided that uses a main computer coupled to electrical internal air and water temperature sensors, internal and external air pressure sensors, internal and external air moisture sensors, internal wood moisture meter sensor, and depression temperature differential sensors.

DESCRIPTION OF THE DRAWINGS

FIG. 4 is a perspective view of the support platform showing the flow pattern of air there through.

DESCRIPTION OF THE PREFERRED EMBODIMENT(S)

Figure 1:
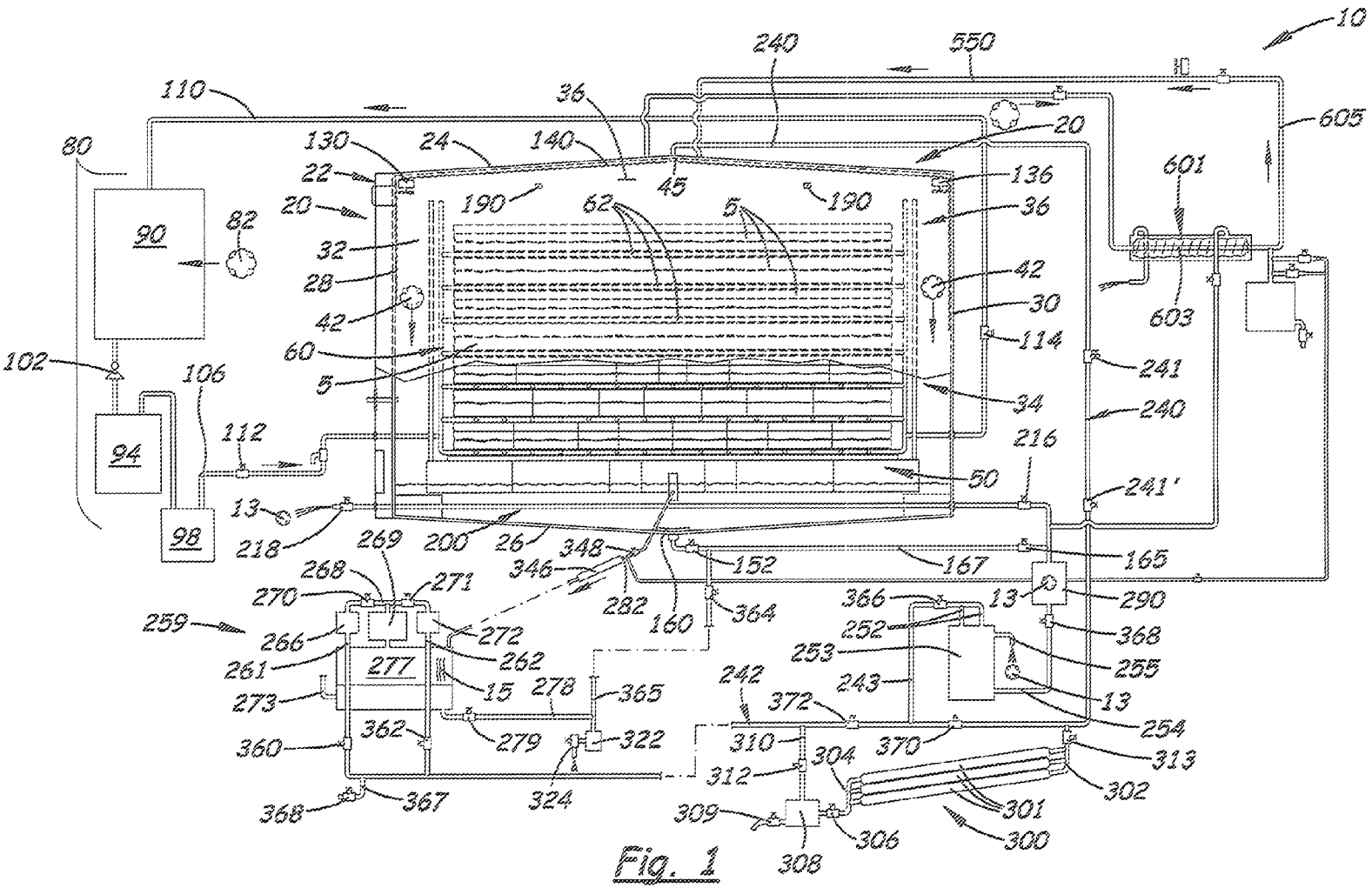
FIG. 1 is an illustration showing the general layout of the multiple stages of the heat and vacuum kiln system disclosed herein.

Referring to the accompanying Figs. there is shown a multiple stage wood vacuum kiln system 10 that includes a hollow, sealed kiln container 20 with a removable platen assembly 60 located therein. The kiln container 20 includes a large outer body 22 with a ceiling wall 24, a bottom floor 26, two side walls 28, 30, a closed end wall 32, and at least one end opening 34. Formed on the front opening 34 is a door 36. The closed end wall 32 may be replaced by a second end opening (not shown) covered by a second door (not shown). Formed inside the outer body 22 is a main cavity 38.

Located inside the main cavity 38 and above the bottom floor 26 is a horizontally support platform 50 upon which the platen assembly 60 is temporarily positioned. The platen assembly 60 includes plurality of platens 62 which are selectively positioned in between stacked layers of wood 5.

Figure 4:
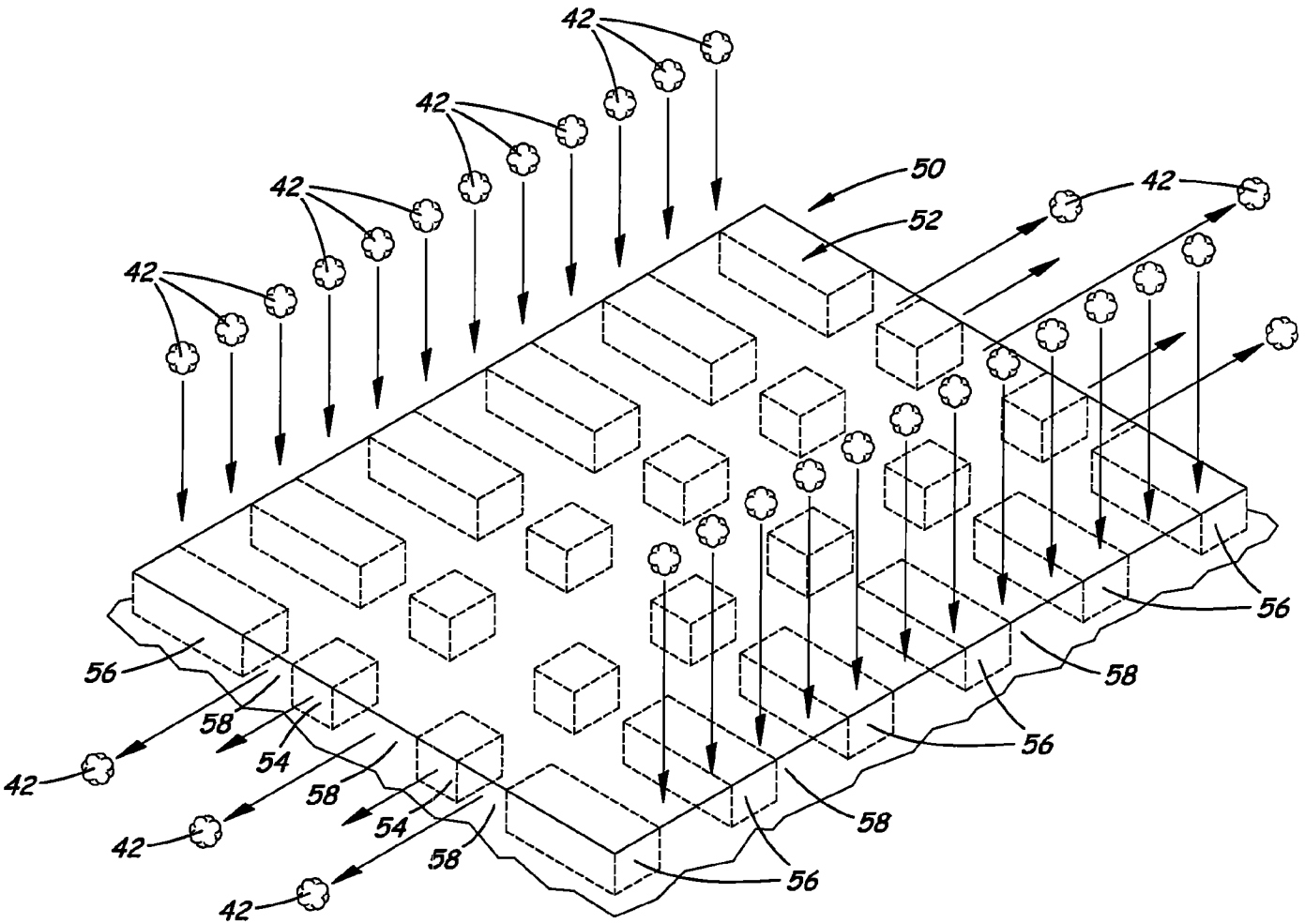

As shown in FIG. 4, the support platform 50 is a flat rigid structure made up of a top plate 52 placed over a plurality of longitudinally and transversely aligned short tubes 54, 56, respectively. The tubes 54, 56 are open at their opposite ends and perpendicularly aligned to each other. The tubes 54 and 56 are evenly spaced apart thereby forming a plurality of interconnected passageways 58 under the top plate 52 through which hot moist air (indicated by the reference number 42 flowing downward from the ceiling wall 24 may travel during operation of the kiln system 10.

Figure 5:
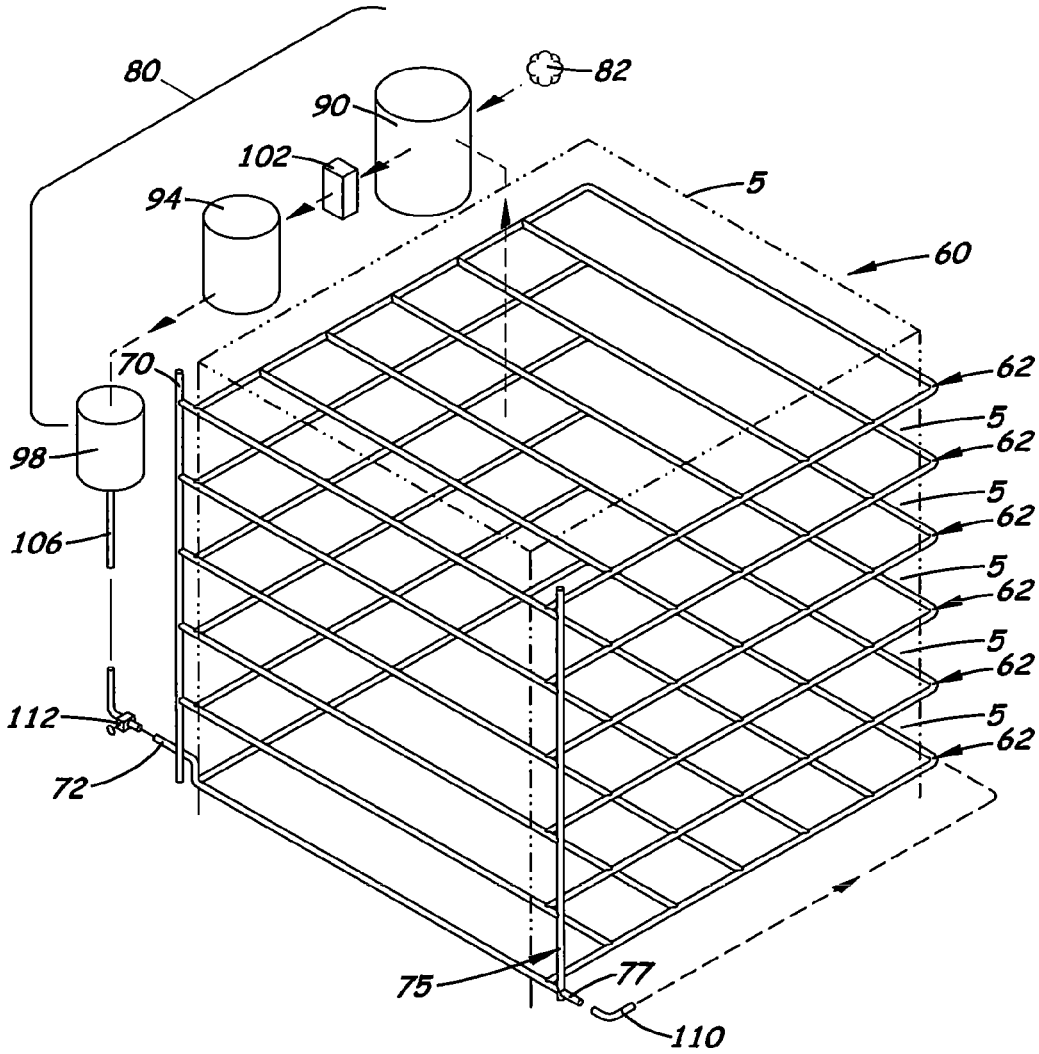
FIG. 5 is a perspective view of the platen assembly showing the platens in a stacked alignment, the water storage tank, the two hot water tanks, the pump and the input and output manifolds.

As shown in FIG. 5, the platen assembly 60 includes a plurality of square or rectangular platens 62 that are filled with hot water. The platens 62 are made of interconnected hollow tubes that are positioned horizontally under each layer of wood 5 and filled with hot water and used to heat the adjacent layers of wood 5. Each platen 62 is connected to a hot water input manifold 70 located on one side of the platen assembly 60 and inside the kiln container 20. The input manifold 70 includes an input port 72 that extends through the side wall 28 or 30 and outside the kiln container 20 and connects to the input conduit 106 connected to a continuous hot water source 80. Located on the opposite side of the plate assembly 60 and inside the kiln container 20 is an output manifold 75 that includes an output port 77 that extends through the opposite side wall 28 or 30 of the kiln container 20 and connects to an output conduit 110 also connected to the hot water source 80.

Figure 2:
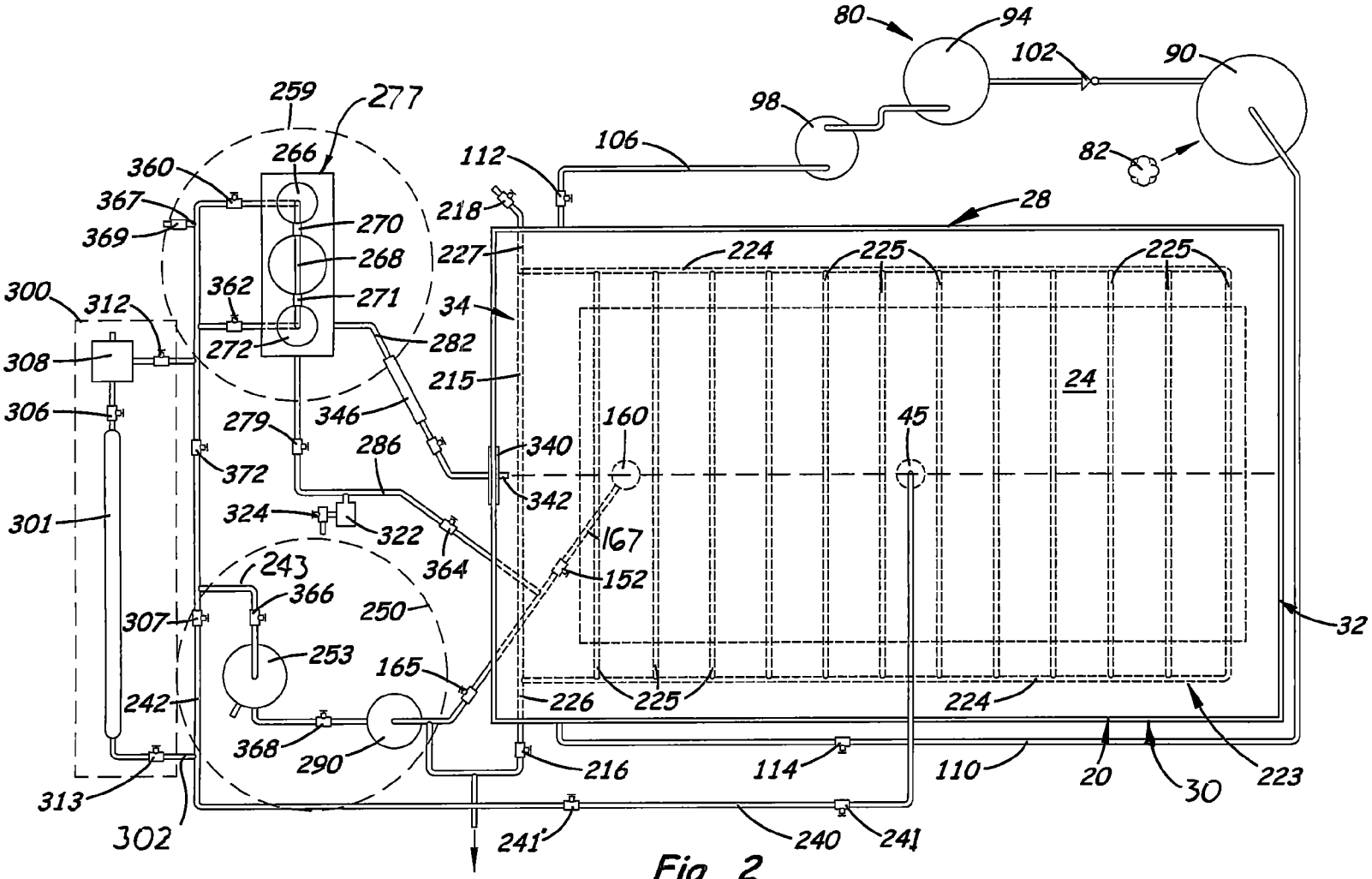
FIG. 2 is a top plan view of the kiln system shown in FIG. 1 without the optional hot air cold water condenser connected to the top of the kiln container and showing the relative locations of the kiln container, the hot water tanks, a cold water source, one positive displacement vacuum pump, two axial flow vacuum pumps, one or more optional reserve vacuum storage tubes, a main condensation tank, and the conduits and valves used therewith.

As shown in FIGS. 1, 2 and 5, the bottom floor 26 is V-shaped or concave in cross-section with a lower, centrally located, dual functional drain port 160. The drain port 160 is connected to a cold water source 290 via a conduct 167. A first valve 152 connects to the conduit 167 to the input/output port 160. A second valve 165 is connected to the conduit 167 downstream from the first valve 152. When the first valve 152 and the second valve 216 are both opened, cold water 13 is able to flow from the cold water source 290 through the drain port 160 and into the kiln container 20. Eventually, sufficient amount of cold water 13 fills the kiln container 20 to form a cold water bath 20 that covers the entire bottom floor 26. The drain port 160 is also connected to a main drain conduct 282 that connects to a primary condensation tank 277.

Figure 3:
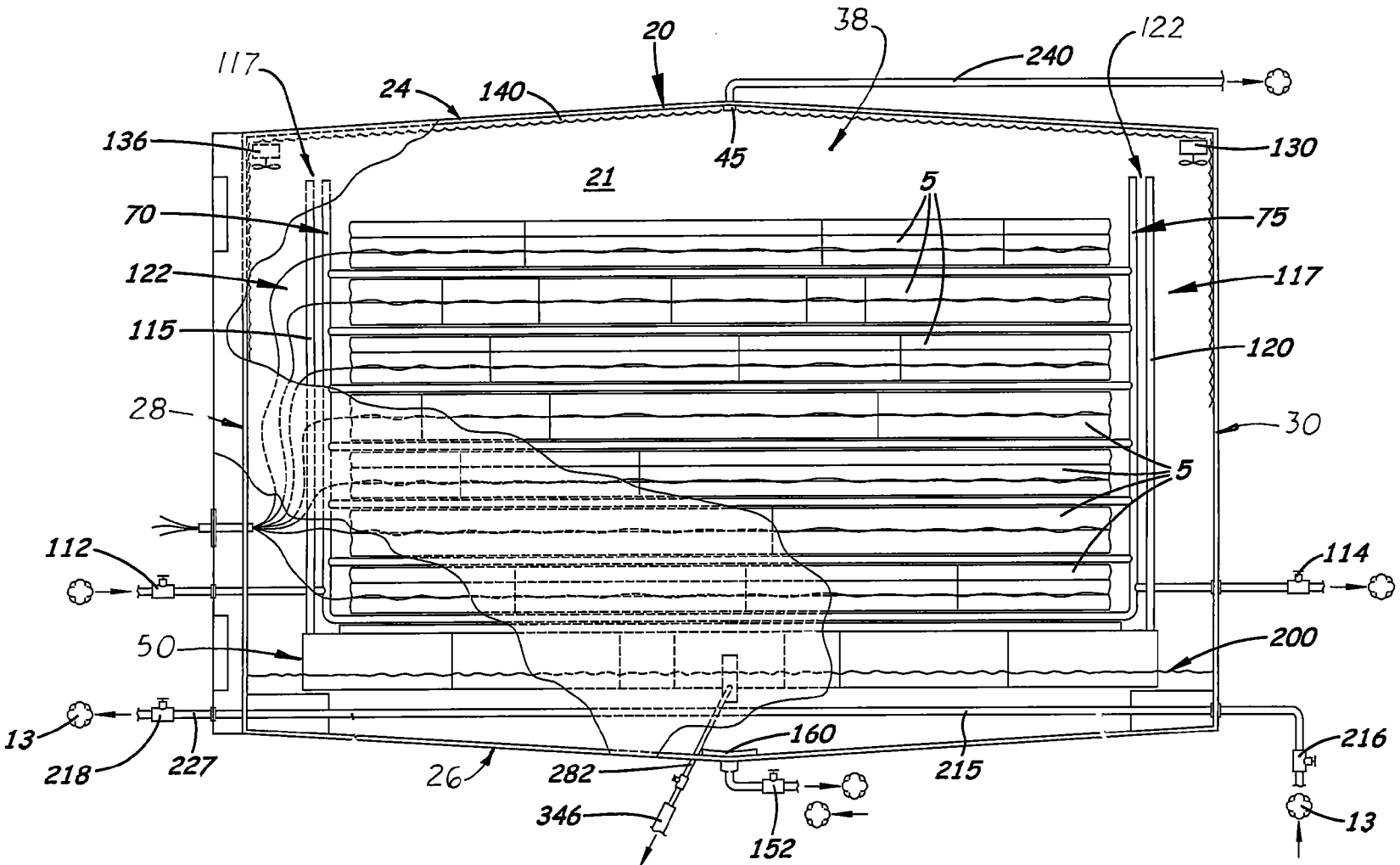
FIG. 3 is a partial end elevation view of the kiln container with a stack of wood located on a support platform and positioned over a cold water bath formed inside the kiln container with the electrical discharge system mounted on the kiln container and used to prevent stalls.

As shown in FIG. 3, located on the sides of the side walls 28, 30 of the kiln container 20 adjacent to the two manifolds 70, 75 are two spaced apart, vertically aligned insulation panels 115, 120, respectively. The two insulation panels 115, 120 extend substantially the entire length of the kiln container 20. The two insulation panels 115, 120 are spaced apart from the side walls 28, 30, respectively, thereby forming two vertically aligned air ducts 117, 122, respectively. The two air ducts 117, 122 extend downward from the upper air space 21 created along the ceiling wall 24 to the outer edges of the support platform 50. During assembly, layers of wood 5 are stacked centrally inside the main cavity so that the two insulation panels 115, 120 are located adjacent to the exposed opposite sides of each layer of wood 5. The length of the layers of wood 5 are restricted so that the front and back ends of each layer of wood 5 are surrounded by hot air during operation of the kiln.

In the embodiment shown in FIGS. 1 and 3, the ceiling wall 24 is pitched at the center and tilts downward towards the two side walls 28, 30 so that condensed water that collects on the ceiling wall 24 flows via gravity towards the two side walls 28, 30. Located near the ceiling wall 24 on opposite sides of the kiln container 20 are one or more arrays of fan arrays 130, 136 that continuously force moist air 42 created inside the upper air space 21 downward through the two air ducts 117, 122, respectively, during the 'drying stage' described further below. Also attached to the inside surface of the ceiling wall 24 and partially extending down the opposite sides of the kiln container 20, is a layer of wicking material 140 that collects the condensed water on the ceiling wall 24 and on the upper areas of the side walls 28, 30 and prevents it from dripping onto the layers of wood 5.

As shown in FIGS. 1 and 3, the bottom floor 26 is V-shaped or concave in cross-section with a lower, centrally located, dual functional drain port 160. The drain port 160 is connected to a cold water source 290 via a conduct 167. A first valve 152 connects to the conduit 167 to the input/output port 160. A second valve 165 is connected to the conduit 167 downstream from the first valve 152. When the first valve 152 and the second valve 165 are both opened, cold water 13 is able to flow from the cold water source 290 through the drain port 160 and into the kiln container 20. Eventually, sufficient amount of cold water 13 fills the kiln container 20 to form a cold water bath 20 200 that covers the entire bottom floor 26.

As shown in FIG. 2, extending into the kiln container 20 and submerged in the cold water bath 200 is a cold water conduit system 223. The conduit system 223 is a square or rectangular mesh like structure made of two longitudinally aligned hollow tubes 224 that extend near the side walls 28, 30, and a plurality of transversely aligned hollow tubes 225. The conduit system 223 includes an input port 226 and an output port 227 that extend outside the opposite sidewalls of the kiln container 20. The input and output ports 226, 227 are connected to two valves 216, 218, respectively, that control the flow of cold water through the conduit system 223.

Figure 9:
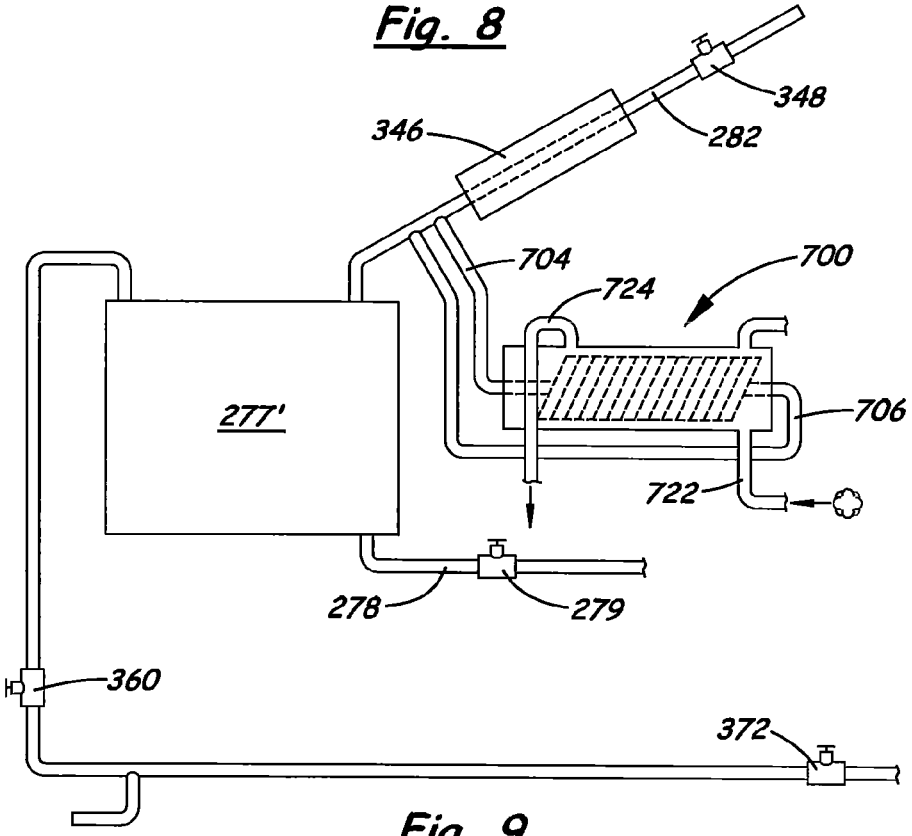
FIG. 9 is an illustration similar to FIG. 8 diagram showing a large primary condensation tank used in conjunction with the primary condensation tank and showing the steam and water condensator 700 attached to the drain conduit.

Also attached to the kiln container 20 is a primary condensation tank 277 in which water 15 removed from the layers of wood 5 during the 'drying stage' is deposited. Extending between the kiln container 20 and the primary condensation tank 277 is a drain conduit 282 (see FIG. 1). In the embodiment shown herein, the drain conduit 282 is connected to the lower section of the door 34. As shown in FIG. 9, mounted on the lower section of the door 34 is an optional viewing window 340. Extending through the viewing window 340 is a bent drain tube 342. The drain tube 342 is positioned inside the kiln container 20 so that its top opening 344 is located at the top surface 202 of the water bath 200. When condensed water 15 collects in the water bath 200 an equal amount of water flows through the top opening 344 of the drain tube 282 and eventually drains into the primary condensation tank 277.

Located within the drain conduit 282 is an optional transparent collection tube 346 that allows the operator to view and if desired, measure the total amount of water 15 removed from the kiln container 20 during 'drying stage'. During operation, the operator visually monitors through the flow of water into the top opening 344 and the measures the total amount of water collected in the collection tube 346. By monitoring both of them, the operator is able to access the drying stages' taking place inside the kiln container 20.

As shown in FIGS. 1 and 3, formed at the top of peak or apex of the ceiling wall 24 is a vacuum port 45. Connected to the vacuum port 45 is a main vacuum conduit 240. Connected to the main vacuum conduit 240 is a relief valve 241 that is used to release the vacuum inside the kiln container 20 so that the door 34 may be manually opened after the 'drying stage' is completed. After the relief valve 241', the main vacuum conduit 240 divides into two secondary conduit branches 242, 243. The second conduit branch 243 connects to a primary vacuum pump system 250 (indicated generally in FIG. 2) and the second conduit branch 242 connects to an auxiliary vacuum pump system 259 (also indicated generally in FIG. 2).

Figure 6:
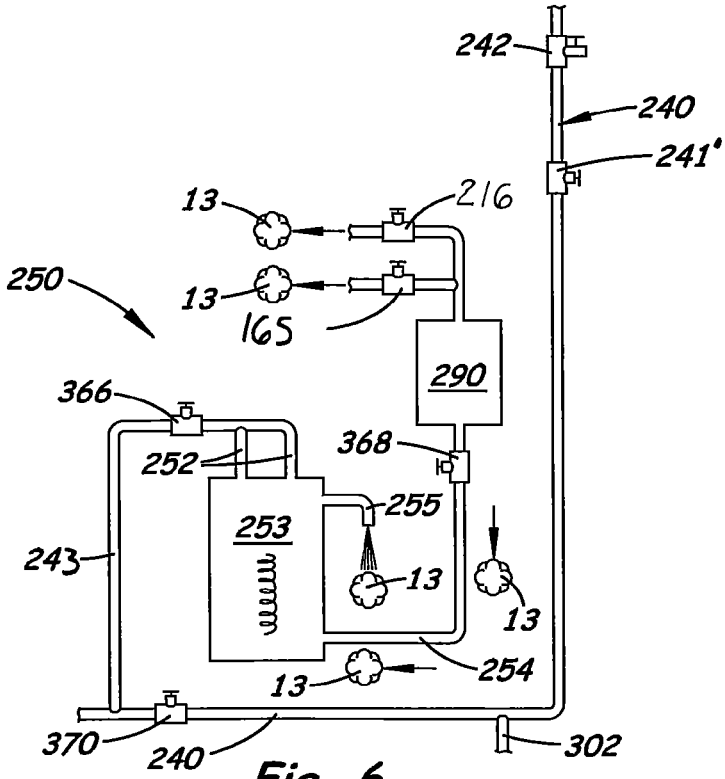
FIG. 6 is a diagram of the positive displacement vacuum pump connected to the main vacuum line and to the cold water source.

As shown in FIGS. 1, 3 and 6, the primary vacuum pump system 250 and the ancillary vacuum system 259 are arranged and connected in a parallel alignment. The secondary conduit branch 243 is divided into two branches 252 that connect to a positive displacement vacuum pump 253. A branch cutoff valve 366 is connected to the conduit branch 243 that allows the positive displacement vacuum pump 253 to be isolated, if desired, from the secondary conduit 242. After the cutoff valve 366, the conduit branch 252 is divided into two input conduits 252 that connect to the positive displacement vacuum pump 253. The positive displacement vacuum pump 253 is water cooled and includes a cool water inlet conduit 254 that connects to the cold water source 290. A valve 368 is connected to the inlet conduit 254 and used to control the flow of cold water 13 from the cold water source 290 to the positive displacement vacuum pump 253. Also connected to the positive displacement vacuum pump 253 is an exhaust/water discharge conduit 255. During operation, cold water 13 is delivered to the positive displacement vacuum pump 253 to cool the pump 253 and is then deposited externally through the discharge conduit 255.

Located on the main vacuum conduit 240 before branching into the secondary conduit branch 242 is a secondary shut off valve 370 that enables both the primary and auxiliary pump systems, 250, 259, respectively, to be selectively disconnected from the main vacuum conduit 240 so that only the optional vacuum storage system 300, discussed further below, is connected to the main vacuum conduit 240.

Figure 7:
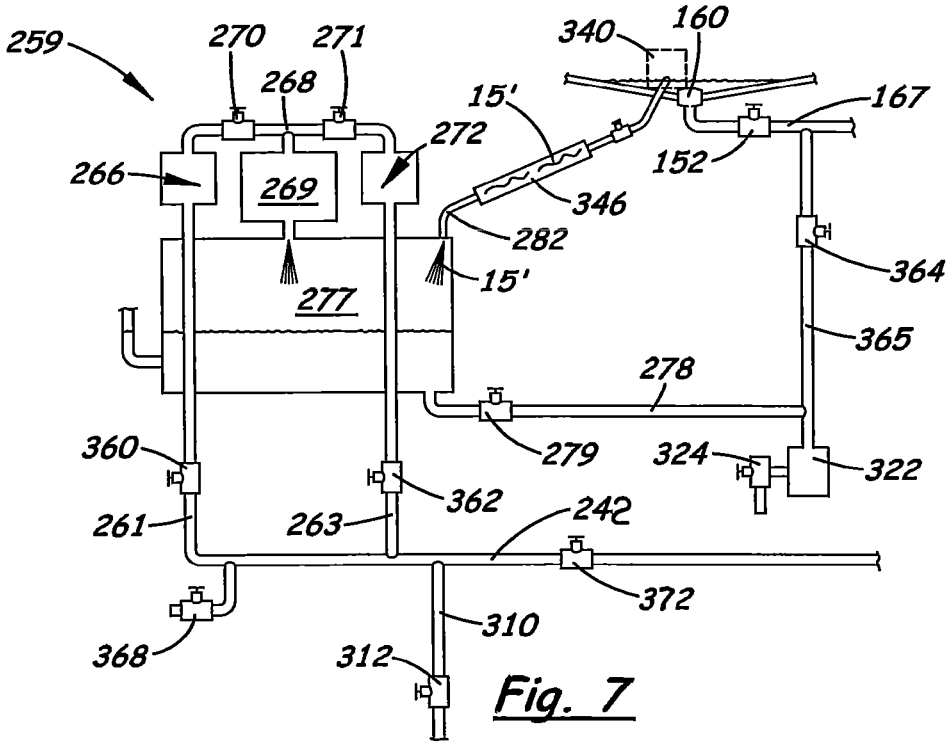
FIG. 7 is a diagram of the auxiliary vacuum pump system that shows two axial vacuum pumps both connected to the main condensation tank, and the main vacuum line, and showing the main condensation tank connected to a drain discharge tube from the kiln container and to a condensation conduit.

The ancillary pump system 259, shown in FIGS. 1, 2 and 7 includes two axial flow vacuum pumps 266, 272 connected to the main vacuum conduit 242 via two ancillary pump conduits 261, 263, respectively. Attached to each ancillary pump conduit 261, 263 is an ancillary shut off valve 360, 362, respectively. The axial flow vacuum pumps 266, 272 are interconnected by an intermediate conduit 268 that connects to a filing chamber 269. Attached to the intermediate conduit 268 prior to the filing chamber 269 are two shut off valves 270, 271 that enable the two axial flow vacuum pumps 266, 272 to be isolated from each other during operation.

Figure 8:
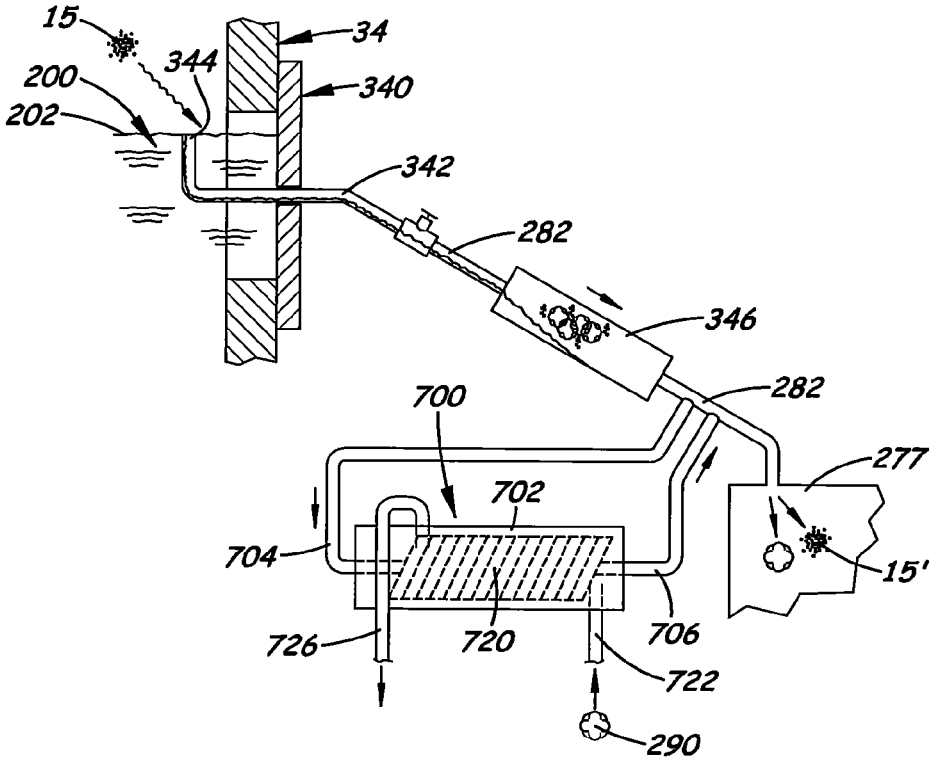
FIG. 8 is a sectional side elevation view of the door in a closed position on the kiln container with a cold water bath formed therein and showing the top of the drain tube located at the top surface of the cold water bath and connected to a collection tube located between the kiln container and the main condensation tank, and showing an optional cold water condenser connected to the collection tube, and a water condensator 700 attached to the drain conduit.

FIG. 8 is an illustration shows an optional water condensator 700 used to condense the hot steam discharge and to cool the air and the hot water discharge from the kiln container 20 before it is delivered to the primary condensation tank 277. By condensing the hot steam discharge and cooling the air and the hot water discharge, the amount of steam delivered to the primary condensation tank 277 is also reduced and the overall temperature of the water collected in the primary condensation tank 277 is reduced which prevents stalling or boiling. The steam and water condensator 700 includes a sealed outer tank 702 with a hot steam inlet port 704 and a steam outlet port 706 formed on its opposite ends. Located inside the outer tank 702 is a cold water coil 720 that includes a cold water inlet port 722 connected to a cold water source 290. Water expelled from the cold water outlet port 726 is discharged onto the ground.

FIG. 9 is an illustration showing a large primary condensation tank 277' used in place of the primary condensation tank 277 shown in FIGS. 1, 2, 7, and 8. By using a large condensation tank 277', a large vacuum can be created thereby eliminating the need for the auxiliary vacuum pumps. Attached to the drain conduit that leads to the large primary condensation tank 277' is a water condensator 700.

Figure 10:
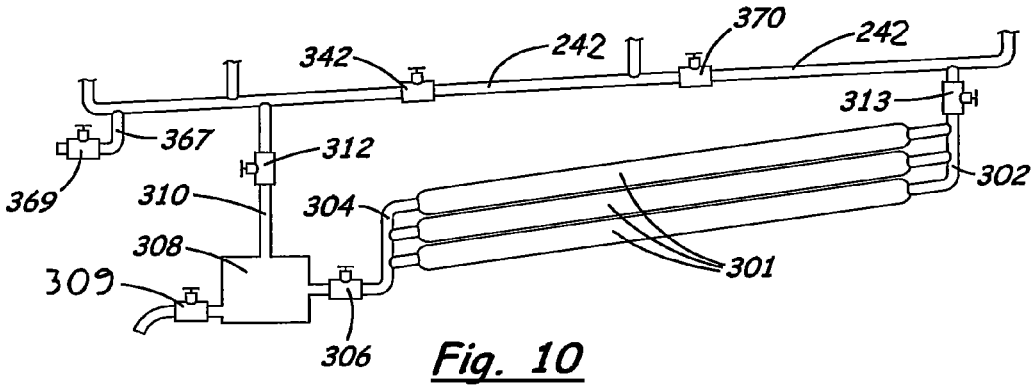
FIG. 10 is a diagram showing the vacuum storage tanks connected at two ends to the secondary conduit branch that connects to the main vacuum line.

FIG. 10 is a diagram showing three vacuum storage system 300 that includes three tanks 301 connected at their opposite ends to two manifolds 302 and 304. The input manifold 302 is connected to a short conduit 303 that connects to the secondary vacuum line 244. Located in the short conduit 303 is a valve 313. The output manifold 302 is connected to a short conduit 303 that connects to a condensation collection tank 308. A valve 306 is mounted on the short conduit 307. The condensation collection tank 308 is connected to a short conduit 310 that connects to the secondary vacuum line 244. Mounted on the short conduit 310 is a valve 312.

In the first embodiment, shown in FIGS. 1, 2 and 7, the filing chamber 269 is connected to the primary condensation tank 277. As discussed above, the primary condensation tank 277 is connected to the drain conduit 282 that attaches to the door 36 on the kiln container 20 and used to evacuate air and collected water and steam therefrom. Attached to the primary condensation tank 277 is an optional water level sight gage 273 that enables the operator to determine the total amount of water and condensed water removed from the wood.

During each stage of operation, water from the kiln container 20 is collected inside the primary condensation tank 277. Attached to the lower section of the primary condensation tank 277 is a condensation conduit 278 that extends to a drain box 322. Attached to the conduit 278 is a shut off valve 279. Also, connected to the drain box 322 is a shut off valve 324. Drain box 322 is also connected to the secondary conduit branch 367 and a shut off valve 368 attached thereto.

In the first embodiment, the main vacuum conduit 240 is sloped downward so that condensation that forms inside the main vacuum conduit 240 flows downward towards the drain valve 368. Connected to the main vacuum conduit 240 is a discharge conduit 367 with the drain valve 368 connected thereto that is selectively opened and closed by the operator to remove condensation formed in the main vacuum conduit 240.

During the 'cooking stage', the positive displacement vacuum pump 253 is used to reduce the air pressure inside the kiln container 20. The control valves 112 and 114 are opened to deliver hot water to the platens 62. The positive displacement vacuum pump 253 is then activated so that the pressure inside the kiln container 20 is lowered to approximately 13 inches of Hg. Control valve 364 is also closed. Hot water is then delivered to the platens 62 to slowly raise the temperature of wood to 140 to 170 degrees F. depending on the type of wood and its moisture content. When the desired temperature of the layers of wood 5 is obtained, the 'cooking stage' is continued for 8 to 12 hrs.

During the 'drying stage', control valves 152 and 216 are opened so that cold water 13 is delivered from the cold water source 290 to the bottom of the kiln container 20 to create the cold water bath 200. After the cold water bath 200 has been formed control, valves 152 and 216 are closed. Control valves 216 and 218 are opened to allow cold water to enter the cold water conduits to cool the cold water bath 200. The control valves 112 and 114 remain opened to deliver hot water to the platens 62. Valve 241' and 313 are then opened which allows the vacuum inside the vacuum storage tanks 301 to quickly lower the air pressure inside the kiln container 20. The primary vacuum pump 253 is activated and valve 366, 370, and 372 are opened. If desired, auxiliary pump 266 is activated and valves 360 and 270 are opened. The air pressure inside the primary condensation tank 277 is gradually lowered than the air pressure inside the kiln container 20 when the valve 241' is closed. When the air pressure inside the primary condensation tank 277 is lower than the kiln container 20, valve 348 is opened. Hot steam discharge and hot water discharge is then delivered through the conduit 282.

Figure 11:
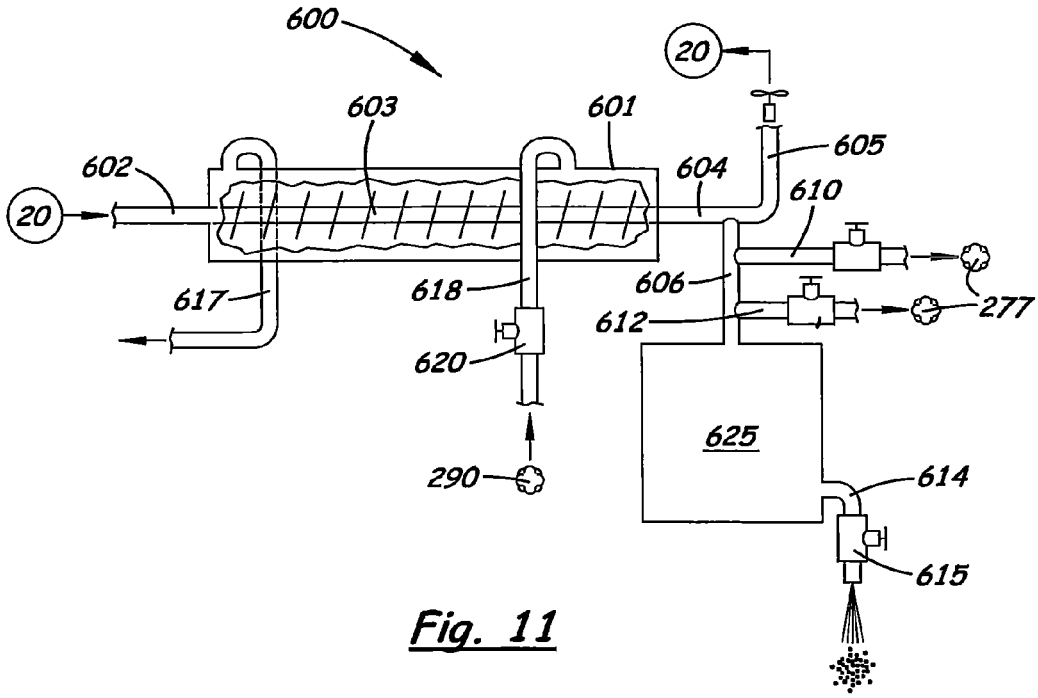
FIG. 11 is a side elevational view of an optional cold water condenser connected to the kiln container and a primary condensation collection tank used to collect condensed hot steam from the kiln container and prevent stalls.

FIG. 11 is an illustration of an optional water condenser 600 that connects to a hot steam conduit 550 that attaches to the top of the kiln container 20. The water condensation 600 includes a condensation tank 601 is to remove excessive moisture from the kiln container 20 during the 'drying stage'. The water condensation tank 601 includes a hot steam conduit 602 that attaches to the hot steam conduit 550. The water condensation tank 601 is hollow and filled with cold water from the cold water source 290. During use, cold water circulates inside the water condenser 600 and cools the hot water steam traveling through the hot steam conduit 602. The hot steam conduit 602 connects to a return conduit 605 that reconnects to the top of the kiln container 20. Fans are located inside the return conduit 605. When the hot steam travels through the water condensation tank 601 it condenses and flows via gravity into a condensation collection tank 625. The condensation collection tank 625 is connected to a branch conduit 606 that connects to a return conduit 605. Attached to the branch conduit 606 are two relief conduits 610, 612 that connect to the primary condensation tank 277. Connected to the condensation collection tank 625 is an outlet conduit 614 with a discharge valve 615 attached thereto.

During the 'drying stage', the system 10 may stall. To prevent stalling or discontinuation of the 'drying stage', an optional electron wood charging unit 400 may be used to prevent stalls. The electron wood charging unit 400 includes an insulation panel 402 mounted to the side of the kiln container 20. Mounted on the panel 402 is a contact post 404 that extends through the insulation panel. Connected to the end of the post 404 are a plurality of insulated wires 406 that are positioned in between the pieces of wood in each stacked layer of wood. A 15 volt, 60 cycle DC electrical source 410 is then attached to the exposed end of the post 404.

Figure 12:
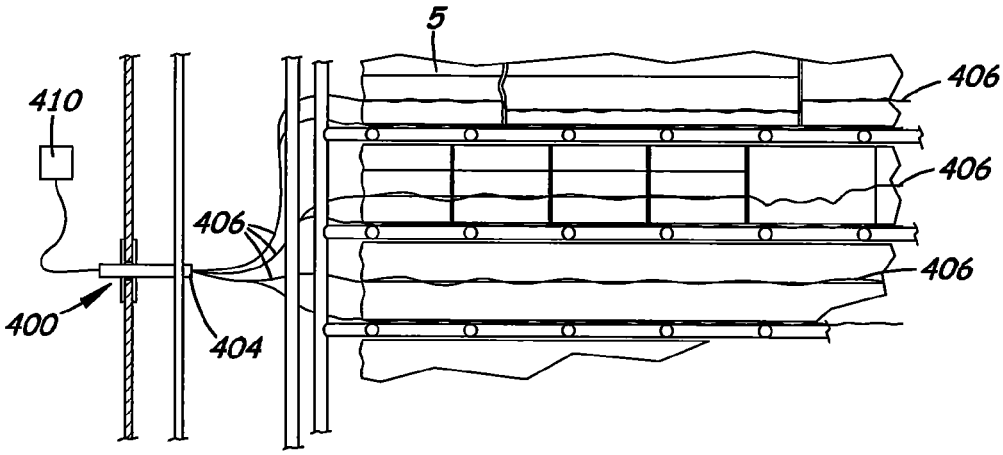
FIG. 12 is a partial sectional, side elevational view showing the electrical current applicator mounted on the side of the kiln container with electrical wires that extend between or around each individual layer of wood in the stack.

FIG. 12 is a partial sectional, side elevational view showing an optional electrical current applicator 400 that may be used with the system that is used to prevent stalling. The electrical current applicator 400 is mounted on the side of the kiln container 20 and includes electrical wires 402 that extend between or around each individual layer of wood 5.

Figure 13:
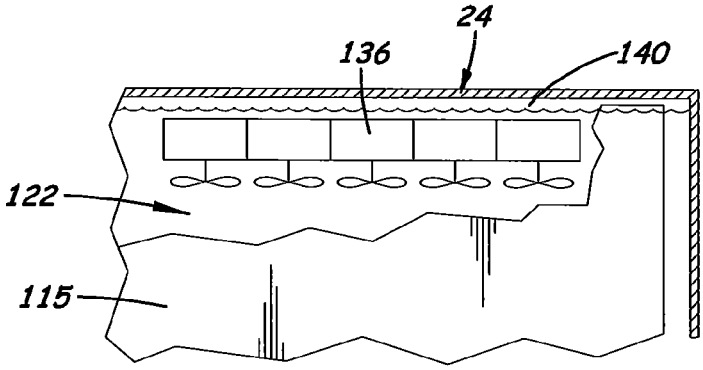
FIG. 13 is a side elevational view of the kiln container showing a bank of five fans located near the tank's ceiling and used to force the hot moist air downward through the air ducks and towards the water bath.

FIG. 13 is a side elevational view of the tank showing a bank of five fans 136 located near the tank's ceiling 24 and used to force the hot moist air downward through the ducks and towards the water bath.

Figure 14:
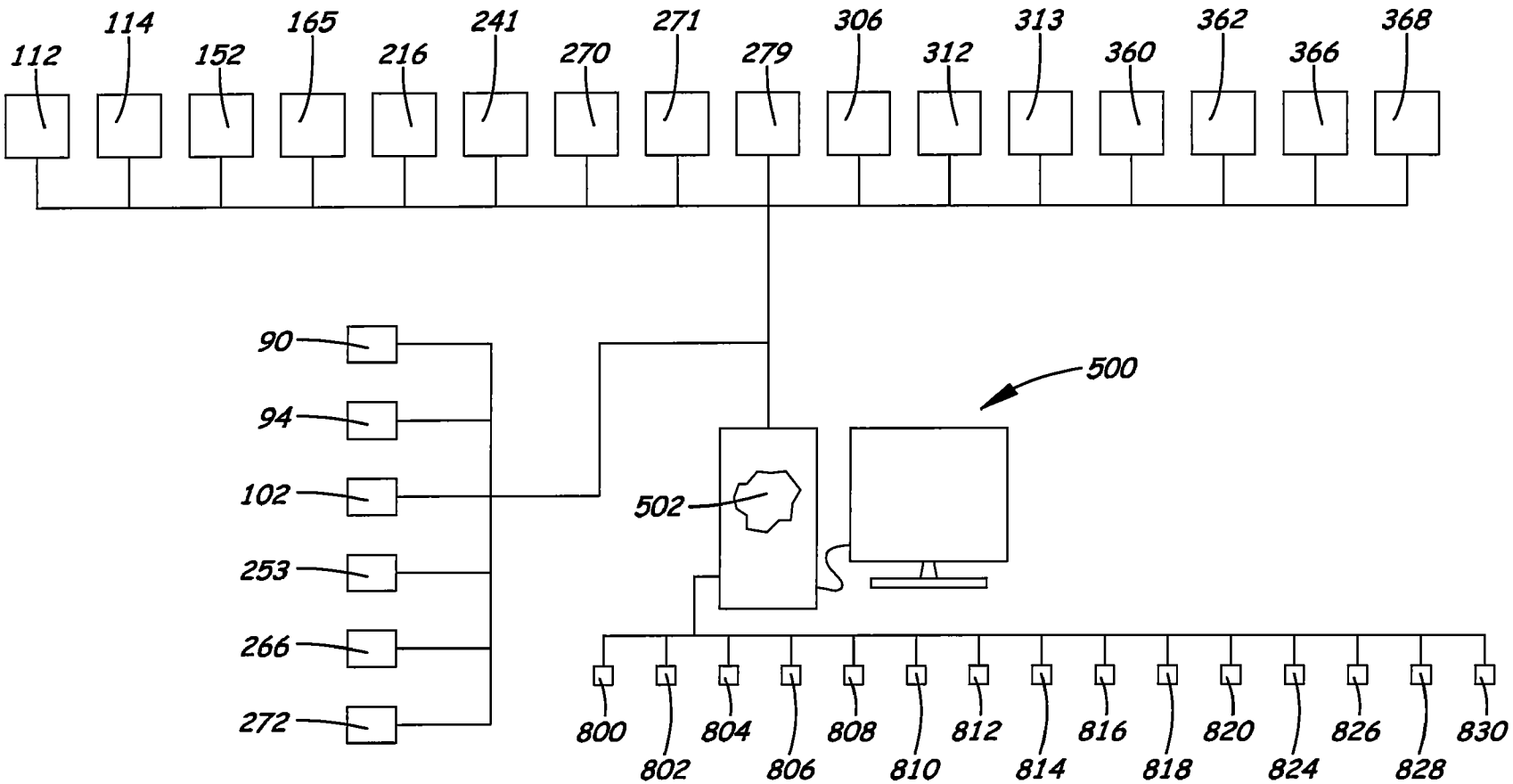
FIG. 14 is an illustration shown a computer coupled to the various valves and components used in the system and with a software program loaded into its memory and used to operate the valves and components during the 'cooking stage' and the 'drying stage'.

As stated above, the entire system 10 may be controlled manually or computer aided with compatible valves. As shown in FIG. 14, a kiln control software 502 is loaded into the computer 500 which controls the operations of the valves 112, 114, 152, 165, 216, 241, 270, 271, 279, 306, 312, 313, 360, 362, 366 and 368 and the components 90, 94, 102, 253, 266, 272. Located on each layer of wood are wood moisture meter sensors 800, 802, 804, 806, 808. Located outside the kiln container 20 is a plurality of outside kiln temperature sensors 810, 812. Also, located at different elevations over the inside surfaces of the kiln container 20, is at least one dual temperature/steam depression temperature sensor 814, at least one outside barometric sensor 816. Located inside the kiln container 20 is a kiln container pressure sensor 818 and connected to the primary vacuum tank is a vacuum pressure sensor 820. Also, coupled to the primary condensation tank is a condensation tank pressure sensor 822, and coupled to the vacuum storage tank system 300 is a vacuum storage tanks pressure sensor 824. Also mounted on the kiln container 20 is a bath water temperature sensor 828 and a kiln container wood temperature sensor 830.

In systems that use an electron wood charging unit 400, a manual controlled system is normally preferred because of electrical interference that may be created.

Cooking Stage

The kiln container 20 is opened and empty. The support platform 50 is removed from the kiln container 20 for loading. All of valves used in the system 10 are closed except valve 306. Wood is then selected and loaded into the support platform 50 in stacked layers with platens 62 placed in between the layers of wood and connect to the two manifolds 70 75. The hot water system 80 is then activated and valves 112 and 114 are opened. Pump 102 is activated to deliver hot water to the platens 62. The door 34 is then closed tight and the main vacuum pump 253 is activated and the valves 366, 370 and 241 are sequentially opened to evacuate the kiln container 20.

Before evacuation of the kiln container 20 is initiated, the operator determines the type of wood to be dried. Most woods are cured and dried at 165 degrees F. Some woods are cured and dried at or around 145 degrees F. Types of wood are cured and dried at or around 125 degrees F.

The current atmospheric pressure is also determined. The current atmospheric pressure acts as a base line for determining how much air must be evacuated without causing the water inside the wood to boil. For example for woods cured and dried at 165 degrees F. and the current atmospheric pressure is 30 inches of Hg pressure, the kiln container is evacuated to approximately 13 inches of Hg pressure during the 'cooking stage' and 0.35 to 1 inch of Hg during the 'drying stage'. If the current atmospheric pressure is 30 inches of Hg pressure then the kiln container 20 is evacuated to 13 inches of Hg pressure during the 'cooking stage' and down to 0.35-1.0 inches of Hg pressure during the 'drying stage. If the wood is cured and dried at 145 degrees F., and the current atmospheric pressure is 30 inches of Hg pressure, then the kiln container 20 is evacuated to approximate 11 inches of Hg pressure during the 'cooking stage' and gradually lowered from 11 to 0.35 to 1.0 inches of Hg pressure during the 'drying stage'.

Once the desired pressures are determined, the main vacuum pump 253 is then activated, and valves 313, 370 are also opened so that the vacuum storage tanks 301 if used, may be evacuated. Valve 241' is then closed, valve 270 is opened and main vacuum pump 253 is activated. During this initial stage, valves 175 and 312 remain closed. Once the pressure inside the storage tanks 300 reaches the desired vacuum pressure, valves 370 and 366 are closed and the main vacuum pump 253 is then deactivated. Once the vacuum storage tanks 301 are evacuated, the valves connecting to the vacuum storage tanks 301 are closed so that the vacuum storage tanks 301 is ready to quickly lower the air pressure in the kiln container 20 and conduits during the initiation of the 'drying stage' if desired.

During the 'cooking stage', the two axial flow vacuum pumps 266 and 272 are inactivated and the valves 360 and 362 are closed so that the auxiliary pumping system 259 is isolated from the kiln container 20 and from the primary pump system 250.

The kiln container 20 is then continuously operated in the 'cooking stage' using only the hot water system' for 8 to 12 hrs.

Drying Stage b20

After 8-12 hours, the 'cooking stage' is completed and the 'drying stage' is commenced. Valves 152 and 165 are opened so that cold water may flow thru the input/output port 160 to flood the bottom of kiln container 20. Cold water is allowed to fill the kiln container 20 until it reaches the top of the tube 342 tube. Valves, 152 and 165, then closed. Valves 241' and 313 are then opened to evacuate the air from the kiln container 20 until the air pressure inside the kiln container 20 reaches 8 to 10 inches of Hg. pressure. Valve 241 is then closed. The main vacuum pump 253 is activated and valves 366, 370, 372, 360, ×4 are sequentially opened. The first auxiliary vacuum pump 266 is activated until the air pressure inside the primary condensation tank 277 is lower than the air pressure inside in the kiln container 20. If needed, the second auxiliary vacuum pump 272 may be used to provide additional vacuum pressure if needed. Valve 348 is then opened which further evacuates the kiln container 20. During the 'drying stage', the fans 130, 136 may be used when the moisture meters 190 located inside the kiln container 20 indicate the moisture content of the wood is 6-8% (hardwoods) or 13-17% (softwoods). The 'drying stage' is then completed.

The hot water system 80 and pump 102 are deactivated and valves 112, 114 are closed. Value 241 is now opened to allow outside air to enter the kiln container 20 until the pressure inside the kiln container 20 reaches approximately 26 inches of Hg. pressure Valves 152, 364, 284, 324, and 348 are opened which causes the water located on the bottom of the kiln container 20 to drain through the port 322. Valves 242 and 306 remain open so that the inside pressure in the kiln container 20 eventually returns to normal atmospheric pressure. After pressure inside and outside pressures have equalized, the door 34 is then opened and stacked layers of wood 5 may be removed from the kiln container 20. Once completed, all of the valves are then closed except valve 306.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A wood kiln system suitable for sequentially cooking and drying wood using heat directly applied to the wood and vacuum air pressures, comprising:

a. a hollow kiln container used to first cure and then dry wood, said kiln container includes a front opening, at least one door that selectively opens and shuts over said front opening, a bottom surface, and a top surface, said kiln container includes an vacuum port located near or on said top surface;

b. a main vacuum conduit connected to said vacuum port on said kiln container;

c. a platen assembly located inside said kiln container upon which a stack of wood to be cured and dried is placed, said platen assembly includes a plurality of hollow platens that may be filled with hot water and individually positioned between layers of wood to directly and evenly heat the layers of wood;

d. a hot water source connected to each said platens;

e. a vacuum pump connected to said main vacuum conduit and used to selectively lower the air pressure inside said kiln container first to approximately 13 inches of Hg pressure to cure wood and then lower the air pressure inside said kiln container to approximately 0.35 inches of Hg pressure to dry said wood;

f. a cold water source connected to said kiln container to form a cold water bath inside said kiln container, said cold water bath having a visible top level and being a sufficient low temperature that causes the water vapor formed in said kiln container to cool and condense thereon which causes said top level of said cold water bath to rise in said kiln container;

g. a condensation tank selectively connected to said main vacuum conduit, when said vacuum pump is activated, said condensation tank removes condensed water and water vapor from said kiln container produced when said wood is dried inside said kiln container;

h. a drain tube extending into said kiln container, said drain tube includes an input port and an outlet port, said outlet port being connected to said condensation tank, said inlet port being located inside said kiln, container at or slightly above the top level of said cold water bath formed inside said kiln container, whereby when said vacuum pump is activated, a vacuum force is created in said condensation tank and said drain tube which removes water vapor and condense water formed in said cold water bath;

i. a drain port attached to said kiln container to remove said water bath from said kiln container; and, j. wicking material located on said top surface of said kiln container.

2. The wood kiln system as recited in claim 1, further including a cold water conduit filled with cold water located inside said kiln container, said cold water conduit that extends into said cold water bath so that said cold water bath remains a cool temperature during the drying stage.

3. The wood kiln system as recited in claim 1, further including a viewing window formed on said door that enables said input port on said drain tube to be seen.

4. The wood kiln system as recited in claim 1, further including a collection tube connected to said drain tube enabling an operator to view the flow of condense water moving through said drain tube.

5. The wood kiln system as recited in claim 1, further including a support platform located inside said kiln container and above said cold water bath, said support platform includes a top plate upon which said layers of stacked wood is placed.

6. The wood kiln system, as recited in claim 5, wherein said support platform is positioned above said cold water bath and includes a plurality of interconnected passageways formed under said top plate that enables hot moist air to circular under said top plate and contact said cold water bath.

7. The wood kiln system as recited in claim 5, further including at least one air duct formed inside said kiln container, adjacent to said support platform and extending from said ceiling to said top level of said cold water bath when formed inside said kiln container.

8. The wood kiln system, as recited in claim 7, further including an array of fans located near said ceiling that force hot moist air through said air duct and through said interconnected passageways.

9. The wood kiln system, as recited in claim 5, wherein said hot water source is a hot water tank that raises and maintains the temperature inside said container from 125 to 170 degrees F.

10. The wood kiln system, as recited in claim 1, wherein said vacuum pump includes a main vacuum pump and an auxiliary vacuum pump serially connected together.

11. The wood kiln system, as recited in claim 10, wherein said main vacuum pump is a positive displacement vacuum pump and said auxiliary vacuum pump is an axial flow vacuum pump.

12. The wood kiln system as recited in claim 11, further including a vacuum storage tank selectively coupled to said main vacuum conduit.

13. The wood kiln system as recited in claim 10, further including a vacuum storage tank selectively coupled to said main vacuum conduit.

14. The wood kiln system as recited in claim 1, further including a vacuum storage tank selectively coupled to said main vacuum conduit.

15. The wood kiln system, as recited in claim 1, further including a water vapor condensation system used to reduce the amount of hot water vapor formed inside of said kiln container.

16. The wood kiln system, as recited in claim 1, further including a water vapor condensation system used to reduce the amount of hot water vapor formed inside of said condensation tank.

17. A method of quickly and efficiently cooking and drying a stack of wood with minimal wood damage, comprising the following steps:

a. selecting a kiln system that includes a hollow kiln container configured to cure and dry wood, said kiln container includes a front opening, at least one door that selectively opens and shuts over said front opening, said kiln container also includes a bottom surface, a top surface and a vacuum port located near or on said top surface;

a main vacuum conduit connected to said vacuum port on said kiln container;

a platen assembly located inside said kiln container upon which a stack of wood is placed to be cured and dried, said platen assembly includes a plurality of hollow platens that is filled with hot water and individually positioned between layers of wood to directly and evenly heat the layers of wood;

a hot water source connected to each said platens;

a vacuum pump connected to said main vacuum conduit and used to selectively lower the air pressure inside said kiln container first to approximately 13 inches of Hg pressure to cure wood and then lower the air pressure inside said kiln container to approximately 0.35 inches of Hg pressure to dry said wood;

a cold water source connected to said kiln container to form a cold water bath inside said kiln container, said cold water bath having a visible top level and being a sufficient low temperature that causes the water vapor formed in said kiln container to cool and condense thereon which causes said top level of said cold water bath to rise in said kiln container;

a condensation tank selectively connected to said main vacuum conduit, when said vacuum pump is activated, said condensation tank removes condensed water and water vapor from said kiln container produced when said wood is dried inside said kiln container;

a drain tube extending into said kiln container, said drain tube includes an input port and an outlet port, said outlet port being connected to said condensation tank, said inlet port being located inside said kiln container at or slightly above the top level of said cold water bath formed inside said kiln container, whereby when said vacuum pump is activated, a vacuum force is created in said condensation tank and said drain tube which removes water vapor and condense water formed in said cold water bath;

a drain port attached to said kiln container to remove said water bath from said kiln container;

wicking material located on said top surface of said kiln container;

b. stacking a plurality of layers of wood on said platen assembly with a platen positioned in between the layers of wood;

c. heating said platens using hot water from said hot water source to raise the temperature of the layers of wood between 125 and 170 degrees F.;

d. evacuating the air from said kiln container using said vacuum pump to lower the air pressure inside said kiln container to approximately 13 inches of Hg pressure;

e. allowing the wood to cure inside said kiln container for 8 to 12 hrs;

f. further evacuating the air from said kiln container with said vacuum pump to lower the air pressure inside said kiln container to approximately 0.35 to 3 inches of Hg pressure and extracting the water and water vapor from said kiln container; and g. allowing the wood to dry inside said kiln container for 6 to 12 hours.

* * * * *